US010468157B2

(12) United States Patent
Hashimoto et al.

(10) Patent No.: US 10,468,157 B2
(45) **Date of Patent: *Nov. 5, 2019**

(54) INSULATED ELECTRIC CABLE

(71) Applicant: SUMITOMO ELECTRIC INDUSTRIES, LTD., Osaka-shi, Osaka (JP)

(72) Inventors: Satoshi Hashimoto, Kanuma (JP); Yuji Ochi, Kanuma (JP); Masayuki Ishikawa, Kanuma (JP); Takami Sagisaka, Kanuma (JP); Takaya Kohori, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/178,802

(22) Filed: Nov. 2, 2018

(65) Prior Publication Data

US 2019/0115123 A1 Apr. 18, 2019

Related U.S. Application Data

(63) Continuation of application No. 15/714,170, filed on Sep. 25, 2017, now Pat. No. 10,262,774, which is a (Continued)

(30) Foreign Application Priority Data

May 1, 2013 (JP) ..... 2013-096607

(51) Int. Cl.
*H01B 7/295* (2006.01)

(52) U.S. Cl.
CPC ..... *H01B 7/295* (2013.01)

(58) Field of Classification Search
USPC ..... 174/34; 439/67
See application file for complete search history.

(56) References Cited

U.S. PATENT DOCUMENTS 1,904,472 A * 4/1933 Kent ..... H01B 9/00 174/115
2,005,614 A * 6/1935 Fassbender ..... H01B 9/00 174/110 AR (Continued)

FOREIGN PATENT DOCUMENTS

JP UM-52-059637 5/1977
JP UM-A-S53-153489 12/1978

(Continued)

OTHER PUBLICATIONS

Fourth Edition Wire Cable Handbook, Published on Oct. 30, 1984, with attached English-language partial translation.

(Continued)

*Primary Examiner* — William H. Mayo, III
*Assistant Examiner* — Krystal Robinson
(74) *Attorney, Agent, or Firm* — Drinker Biddle & Reath LLP

(57) ABSTRACT

An insulated electric cable 10 has a core member 1 formed by stranding a plurality of core wires 4, each of the core wires 4 including a conductor 5 and an insulating layer 6 covering the conductor 5, an inner sheath 7 covering the core member 1, an outer sheath 8 covering the inner sheath 7, and a paper tape 2 disposed between the core member 1 and the inner sheath 7 in a state that it is wrapped around the core member 1, in which the outer sheath 8 is formed by a flame-retardant polyurethane resin, and a cross-sectional area of each of conductors 5 is within 0.18-3.0 mm$^2$.

1 Claim, 3 Drawing Sheets

Related U.S. Application Data continuation of application No. 14/264,088, filed on Apr. 29, 2014, now Pat. No. 9,905,338.

(56) References Cited

U.S. PATENT DOCUMENTS 3,445,394 A * 5/1969 Hunt ..... H01B 3/441 174/110 PM
3,576,723 A * 4/1971 Angele et al. ..... H01B 7/0838 205/187
3,745,233 A 7/1973 Lania et al.
4,096,346 A * 6/1978 Stine ..... F16L 11/06 174/36
4,417,093 A * 11/1983 Occhini ..... H01B 3/20 174/102 SC
4,675,475 A * 6/1987 Bortner ..... D04C 1/06 156/172
4,853,490 A * 8/1989 Bosisio ..... H01B 3/008 174/25 R
5,428,187 A 6/1995 Crane et al.
6,127,632 A 10/2000 Oswald et al.
6,194,663 B1 * 2/2001 Friesen ..... H01B 11/02 174/110 R
6,403,887 B1 * 6/2002 Kebabjian ..... H01B 11/002 174/110 R
6,452,107 B1 9/2002 Kebabjian
6,630,624 B2 * 10/2003 Tsao ..... H01B 7/0861 174/113 R
2001/0002773 A1 * 6/2001 Hyogo ..... H01B 9/003 307/147
2001/0004557 A1 * 6/2001 Scheideler ..... H01B 7/0861 439/67
2001/0040042 A1 * 11/2001 Stipes ..... H01B 11/1016 174/113 R
2002/0017366 A1 * 2/2002 Inagaki ..... H01B 7/0838 156/379.7
2003/0132022 A1 7/2003 Williams et al.
2003/0150633 A1 * 8/2003 Hirakawa ..... H01B 11/002 174/36
2005/0121222 A1 * 6/2005 Lee ..... H01B 11/12 174/113 R
2006/0054334 A1 * 3/2006 Vaupotic ..... H01B 11/1008 174/36
2007/0102187 A1 5/2007 Kundinger
2010/0025072 A1 * 2/2010 Okano ..... H01B 11/1008 174/115
2010/0025075 A1 2/2010 Feichtinger et al.
2010/0147549 A1 6/2010 Shina
2010/0186987 A1 * 7/2010 Aitken ..... H01B 9/028 174/102 R
2011/0139485 A1 6/2011 Matsuda et al.
2011/0235986 A1 * 9/2011 Kaml ..... G02B 6/4453 385/135
2011/0297418 A1 * 12/2011 Temblador ..... H01B 7/189 174/105 R
2011/0311191 A1 * 12/2011 Hayashishita ..... G02B 6/4416 385/101
2012/0031643 A1 * 2/2012 Gromko ..... H01B 11/06 174/113 R
2012/0090866 A1 * 4/2012 Gundel ..... H01B 7/0861 174/34
2012/0267159 A1 * 10/2012 Gundel ..... H01B 7/0838 174/350
2012/0285725 A1 * 11/2012 Maritano ..... H01B 3/52 174/120 FP
2016/0141070 A1 * 5/2016 Heipel ..... H01B 7/04 174/72 A

FOREIGN PATENT DOCUMENTS

JP UM-A-S51-017767 7/1981
JP A-S62-122012 6/1987
JP A-H06-052729 2/1994
JP A-H11-031426 2/1999
JP A-2000-322946 11/2000
JP A-2004-111178 4/2004
JP 2005-158451 A 6/2005
JP A-2005-166450 6/2005
JP A-2006-351322 12/2006
JP 2008-269892 A 11/2008
JP 2010-146755 A 7/2010
JP A-2011-228122 11/2011
JP B-4816719 11/2011
JP A-2012-238438 12/2012
WO WO 99/60578 A1 11/1999

OTHER PUBLICATIONS

Japanese Office Action dated Jan. 6, 2015 issued in Corresponding Japanese Patent Application No. 2013-096607 (including English translation).
"Cable Material", teaching materials for high schools, printed on Nov. 1983, pp. 265 and 324 (with attached English-language translation).
"Wire and cable manual", vol. 1 1st edition, May 1978, China Machine Press, p. 835 (with attached English-language translation).
JP Office Action dated Jul. 23, 2019 from corresponding Japanese patent application No. 2018-220011 (with attached English-language translation).

* cited by examiner

INSULATED ELECTRIC CABLE

TECHNICAL FIELD

The present invention relates to an insulated electric cable including a tape member.

BACKGROUND ART

A cable including a core wire made of a conductor and an insulating layer covering this conductor, a coating layer covering this core wire, and a sheath covering this coating layer is known. In the case of manufacturing this cable, a technique capable of intermittently applying powder to an outer peripheral surface of the core wire along a length direction of the cable and simply peeling the coating layer of the cable and easily taking out the core wire is known (see Patent Reference 1).

PRIOR ART REFERENCE

Patent Reference

[Patent Reference 1] JP-A-2008-269892

SUMMARY OF THE INVENTION

Problems that the Invention is to Solve

However, in a configuration of the cable of Patent Reference 1 described above, the powder applied to the outer peripheral surface of the core wire may fly to the periphery in the case of cutting and removing the sheath and the coating layer in order to take out the core wire. When the powder flies to the periphery of a worker, workability of work taking out the core wire may decrease. Also, it is attempted to decrease using the powder an adhesion between the core wire and the sheath, but the adhesion is not necessarily decreased and it may be difficult to remove the sheath.

An object of the present invention provides an insulated electric cable with good workability of work taking out a core wire.

Means for Solving the Problems

In order to achieve the above object, an insulated electric cable according to the present invention comprises:

a core member formed by stranding a plurality of core wires, each of the core wires including a conductor and an insulating layer covering the conductor;

a first coating layer covering the core member;

a second coating layer covering the first coating layer; and a tape member disposed between the core member and the first coating layer in a state that it is wrapped around the core member, wherein the second coating layer is formed by a flame-retardant polyurethane-based resin, and a cross-sectional area of each of the conductors is in a range of 0.18 to 3.0 $mm^2$.

Advantage of the Invention

According to the invention, an insulated electric cable with good workability of work taking out a core wire can be provided.

MODE FOR CARRYING OUT THE INVENTION

Summary of Embodiments of the Invention

Figure 1:
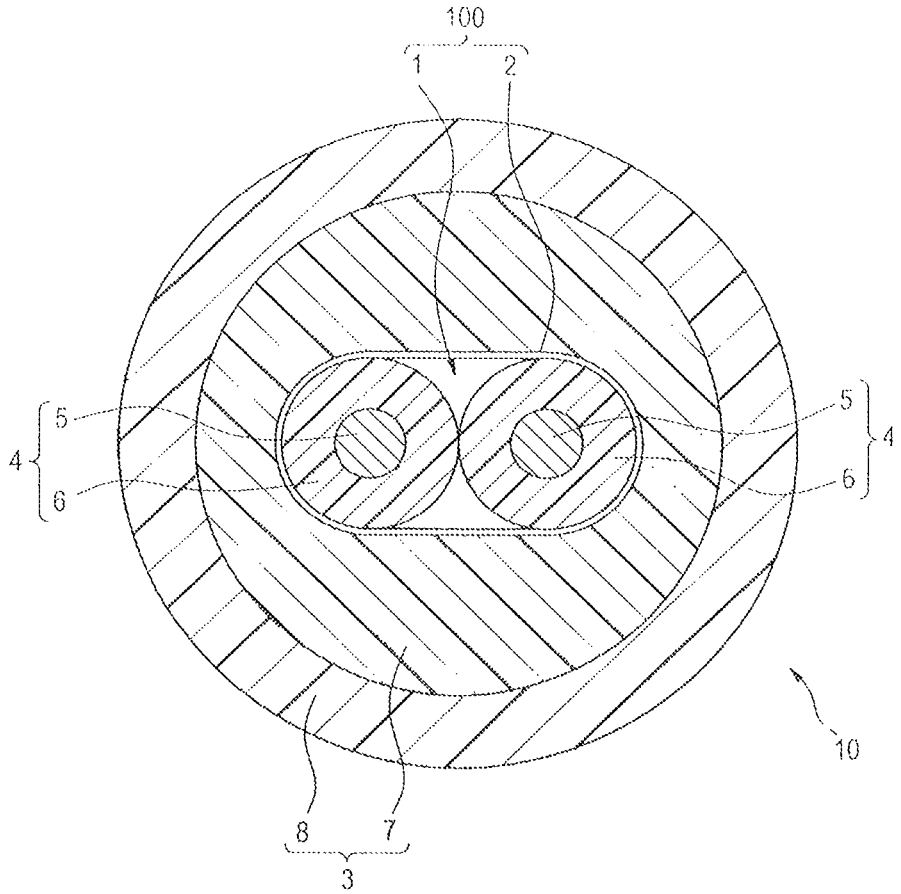
FIG. 1 is a sectional view showing a configuration of an insulated electric cable according to a first embodiment of the invention.

First, a summary of an embodiment of the invention will be described.

(1) An insulated electric cable comprises:

a core member formed by stranding a plurality of core wires, each of the core wires including a conductor and an insulating layer covering the conductor;

a first coating layer covering the core member;

a second coating layer covering the first coating layer; and a tape member disposed between the core member and the first coating layer in a state that it is wrapped around the core member, wherein the second coating layer is formed by a flame-retardant polyurethane-based resin, and a cross-sectional area of each of the conductors is in a range of 0.18 to 3.0 $mm^2$.

The insulated electric cable with the above configuration is suitable to satisfy insulation properties or flame-retardant properties which are required performance for the small-diameter cable of use for a vehicle. Also, in this insulated electric cable, the tape member is disposed between the core member and the first coating layer, and the core member is arranged separately from the first coating layer. As a result, the core member can be easily separated from the first coating layer to be exposed by removing the tape member. An adhesion between the tape member and the first coating layer is always a small value, and it is easy to remove the sheath. Also, since powder etc., do not attach to the core member, the powder etc., do not fly in the case of removing the first coating layer and the second coating layer. Thus, according to the above configuration of the insulated electric cable, workability of work taking out the core member can be improved.

(2) In the insulated electric cable of the above (1), it is preferable that the core member is formed by stranding the two core wires respectively having the same diameter mutually, and a cross-sectional area of the conductor of each of the two core wires is in a range of 1.5 to 3.0 $mm^2$.

According to this configuration, the cable in which the cross-sectional area of the conductor of the core wire constructing the core member is in a range of 1.5 to 3.0 $mm^2$ is obtained, and the cable can be used for the cable mounted in a vehicle.

(3) In the insulated electric cable of the above (1), it is preferable that the core member has two first core wires respectively having the same diameter and two second core wires respectively having the same diameter as the plurality of core wires, and a cross-sectional area of a conductor of each of the two first core wires is in a range of 1.5 to 3.0 mm2, and a cross-sectional area of a conductor of each of the two second core wires is in a range of 0.18 to 0.40 mm2, and the two second core wires are mutually stranded to form a subunit, and the subunit and the two first core wires are stranded to form the core member.

According to this configuration, the insulated electric cable includes the subunit, and this subunit is formed by stranding the two second core wires in which the cross-sectional area of the conductor is in the range of 0.18 to 0.40 mm2. By the insulated electric cable including this subunit, convenience of the cable is improved since electrical signals or power for operating two kinds of systems by one cable can be sent.

(4) In the insulated electric cable of any one of the above (1) to (3), it is preferable that the insulating layer of the core wire is formed by a flame-retardant polyolefin-based resin.

According to this configuration, insulation properties or flame-retardant properties of the core member (core wire) can be ensured even in a state in which the tape member is removed and a part of the core member (core wire) is exposed.

(5) Further, in the insulated electric cable of any one of the above (1) to (4), it is preferable that the first coating layer is any of a polyolefin-based resin, polyurethane elastomer, polyester elastomer, or a compound formed by mixing at least two kinds of these resin and elastomer.

The low-cost cable with good flexibility can be provided by using the polyolefin-based resin such as EVA in the first coating layer. Also, the cable with good abrasion resistance can be provided by using the polyurethane elastomer in the first coating layer. Also, the cable with good heat resistance can be provided by using the polyester elastomer in the first coating layer.

Details of Embodiment of the Invention

One example of the embodiment of an insulated electric cable according to the invention will hereinafter be described in detail with reference to the drawings.

First Embodiment

FIG. 1 is a sectional view showing a configuration of an insulated electric cable 10 according to a first embodiment of the invention. The insulated electric cable 10 is used in, for example, an electro mechanical parking brake (EPB) mounted in a vehicle, and can be used as a cable for sending an electrical signal or power to a motor for driving a brake caliper.

As shown in FIG. 1, the insulated electric cable 10 includes a core member 1, a paper tape 2 (one example of a tape member) wrapped around the core member 1, and a sheath 3 covering an outer periphery of the paper tape 2 wrapped around the core member 1. An outside diameter of the insulated electric cable 10 of the present example is set so as to be in the range of 6 to 12 mm, preferably, the range of 8.3 to 10.3 mm.

The core member 1 is formed by mutually stranding two first core wires 4 (one example of a core wire) respectively having the same diameter mutually. Each of the two first core wires 4 is constructed of a conductor 5 and an insulating layer 6 covering an outer periphery of the conductor 5. In the invention, the term "same diameter" does not mean that the diameters of the two core wires have exactly the same value, and includes the case where the two core wires differ in the range of respective manufacturing variations in a diameter value.

The conductor 5 is, for example, a copper alloy wire made of copper alloy, and is a stranded wire formed by stranding a plurality of wires with an outside diameter of 0.08 mm. The number of wires constructing the conductor 5 is about 360 to 610. A cross-sectional area (cross-sectional area of the total of the plurality of wires) of the conductor 5 constructed in this manner is set so as to be in the range of 1.5 to 3.0 mm2, preferably, the range of 1.8 to 2.5 mm2. Also, an outside diameter of the conductor 5 is set so as to be in the range of 1.5 to 3.0 mm, preferably, the range of 1.8 to 2.6 mm, more preferably, the range of 2.0 to 2.6 mm. In addition, a material constructing the conductor 5 is not limited to the copper alloy wire, and may be a material such as a tin-plated annealed copper wire or an annealed copper wire with predetermined conductivity and flexibility.

The insulating layer 6 is formed by a flame-retardant polyolefin-based resin, and is formed by, for example, flame-retardant cross-linked polyethylene in which flame-retardant properties are imparted by compounding a flame retardant. A thickness of the insulating layer 6 is set so as to be in the range of 0.2 to 0.8 mm, preferably, the range of 0.3 to 0.7 mm. An outside diameter of the insulating layer 6 is set so as to be in the range of 2.4 to 4.0 mm, preferably, the range of 2.5 to 4.0 mm, more preferably, the range of 2.8 to 3.8 mm. In addition, a material constructing the insulating layer 6 is not limited to the flame-retardant polyolefin-based resin, and may be formed by other materials such as a cross-linked fluorine resin.

The paper tape 2 is spirally wrapped around an outer periphery of the core member 1, and is disposed between the core member 1 and an inner sheath 7 described below. As the paper tape 2, a tape whose thickness is in the range of 0.02 to 0.06 mm, preferably, the range of 0.03 to 0.05 mm is used. In addition, a material is not limited to the paper tape, and an artificial fiber tape formed by a resin material such as polyester may be used. Also, a wrapping method is not limited to the spiral wrapping, and may be the wrapping along the longitudinal direction. Also, a wrapping direction may be Z wrapping (clockwise direction) or S wrapping (counterclockwise direction). Also, the wrapping direction may be set in a direction opposite to a stranding direction of each of the core wires 4 of the core member 1. By setting the wrapping direction of the paper tape 2 in the direction opposite to the stranding direction of the core wire 4, it tends not to appear unevenness on a surface of the wrapped paper tape 2 and thereby the outside diameter tends to become stable.

The sheath 3 has a two-layer structure made of the inner sheath 7 (one example of a first coating layer) and an outer sheath 8 (one example of a second coating layer), and is formed so as to cover the core member 1 (hereinafter also called a core member 100 with tape) on which the paper tape 2 is wrapped.

The inner sheath 7 is formed by coating an outer periphery of the core member 100 by extrusion so as to cover the core member 100 with tape. A material constructing the inner sheath 7 is preferably a material with good flexibility. For example, a polyolefin-based resin such as polyethylene or an ethylene-vinyl acetate copolymer (EVA), polyurethane elastomer, polyester elastomer, or a compound formed by mixing at least two kinds of these resin and elastomer can be used, and it is formed by, for example, cross-linked polyethylene. A thickness of the inner sheath 7 is set so as to be in the range of 0.3 to 0.9 mm, preferably, the range of 0.45 to 0.80 mm. An outside diameter of the inner sheath 7 is set so as to be in the range of 6.0 to 10.0 mm, preferably, the range of 7.3 to 9.3 mm.

The outer sheath 8 is formed by coating an outer periphery of the inner sheath 7 by extrusion so as to cover the outer periphery of the inner sheath 7. A material constructing the outer sheath 8 is preferably a material with good abrasion resistance. For example, a flame-retardant polyurethane-based resin can be used, and it is formed by, for example, flame-retardant cross-linked polyurethane. A thickness of the outer sheath 8 can be set so as to be in the range of 0.3 to 0.7 mm and is, for example, 0.5 mm. An outside diameter of the outer sheath 8, that is, an outside diameter of the insulated electric cable 10 is set so as to be in the range of 6 to 12 mm, preferably, the range of 7.9 to 10.7 mm, more preferably, the range of 8.3 to 10.3 mm as described above.

Figure 2:
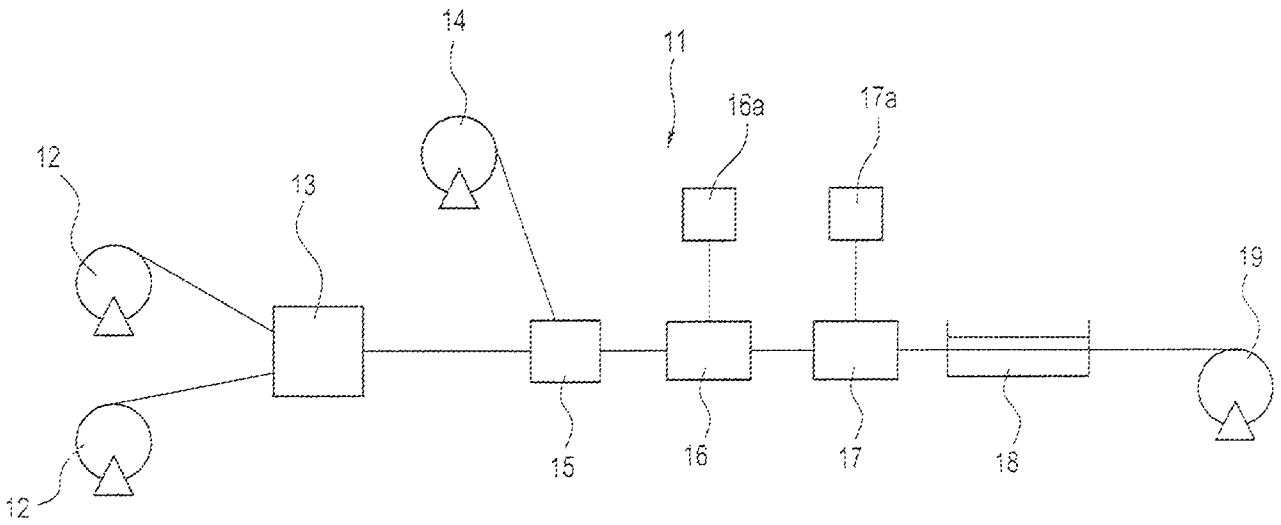
FIG. 2 is a schematic configuration diagram showing a manufacturing apparatus for manufacturing the insulated electric cable according to the first embodiment of the invention.

Next, a method for manufacturing the insulated electric cable 10 will be described. FIG. 2 shows a schematic configuration of a manufacturing apparatus 11 for manufacturing the insulated electric cable 10. As shown in FIG. 2, the manufacturing apparatus 11 includes two core wire supply reels 12, a stranding part 13, a paper tape supply reel 14, a paper tape wrapping part 15, an inner sheath coating part 16, an outer sheath coating part 17, a cooler 18 and a cable winding reel 19.

The first core wire 4 is wound on each of the two core wire supply reels 12, and the two first core wires 4 are supplied to the stranding part 13. In the stranding part 13, the two first core wires 4 supplied are mutually stranded to form the core member 1. This core member 1 is fed to the paper tape wrapping part 15.

In the paper tape wrapping part 15, the core member 1 fed from the stranding part 13 and the paper tape 2 supplied from the paper tape supply reel 14 are joined together and the paper tape 2 is spirally wrapped around an outer periphery of the core member 1 and the core member 100 with tape is formed. This core member 100 with tape is fed to the inner sheath coating part 16.

The inner sheath coating part 16 is coupled to a storage part 16*a* in which a resin material such as cross-linked polyethylene is stored. In the inner sheath coating part 16, the resin material supplied from this storage part 16*a* is extruded and an outer periphery of the core member 100 with tape is coated with the resin material. In this manner, the inner sheath 7 is formed so as to cover the outer periphery of the core member 100 with tape. The core member 100 with tape coated with the inner sheath 7 is fed to the outer sheath coating part 17.

The outer sheath coating part 17 is coupled to a storage part 17*a* in which a resin material such as flame-retardant cross-linked polyethylene is stored. In the outer sheath coating part 17, the resin material supplied from this storage part 17*a* is extruded and an outer periphery of the inner sheath 7 formed by the inner sheath coating part 16 is coated with the resin material. In this manner, the outer sheath 8 is formed so as to cover the outer periphery of the inner sheath 7, and the insulated electric cable 10 coated with the sheath 3 of the two-layer structure made of the inner sheath 7 and the outer sheath 8 is formed. This insulated electric cable 10 is fed to the cooler 18 and the sheath 3 is cooled and cured and then, the insulated electric cable 10 is fed to the cable winding reel 19 and is wound.

As described above, the insulated electric cable 10 is a relatively small-diameter cable in which a cross-sectional area of the conductor 5 of the first core wire 4 constructing the core member 1 is in the range of 1.5 to 3.0 $mm^2$. Also, the outer sheath 8 is formed by a flame-retardant polyurethane-based resin. Thus, the insulated electric cable 10 is suitable to satisfy insulation properties or flame-retardant properties which are required performance for the small-diameter cable of use for a vehicle, and can be used in an electro mechanical parking brake mounted in the vehicle. Also, in the insulated electric cable 10, the paper tape 2 is disposed between the core member 1 and the inner sheath 7, and the core member 1 is arranged separately from the inner sheath 7. As a result, the core member 1 can easily be separated from the inner sheath 7 to be exposed by removing the paper tape 2 in the case of exposing the core member 1 by removing the sheath 3 in order to connect the distal end of the insulated electric cable 10 to a connector or a substrate. Also, since powder etc. do not attach to the core member 1, the powder etc. do not fly in the case of removing the sheath 3. As a result, for example, a hand or clothing of a worker can be prevented from getting messy with the flying powder, or the flying powder can be prevented from hindering worker's view. Thus, according to the above configuration of the insulated electric cable 10, workability of work taking out the core member 1 (each of the core wires 4) can be improved.

Also, the insulating layer 6 of the first core wire 4 is formed by a flame-retardant resin such as a cross-linked fluorine resin or a flame-retardant polyolefin-based resin. As a result, insulation properties or flame-retardant properties of the core member 1 can be ensured even in a state in which the sheath 3 and the paper tape 2 are removed and a part of the core member 1 (the first core wire 4) is exposed.

Second Embodiment

Figure 3:
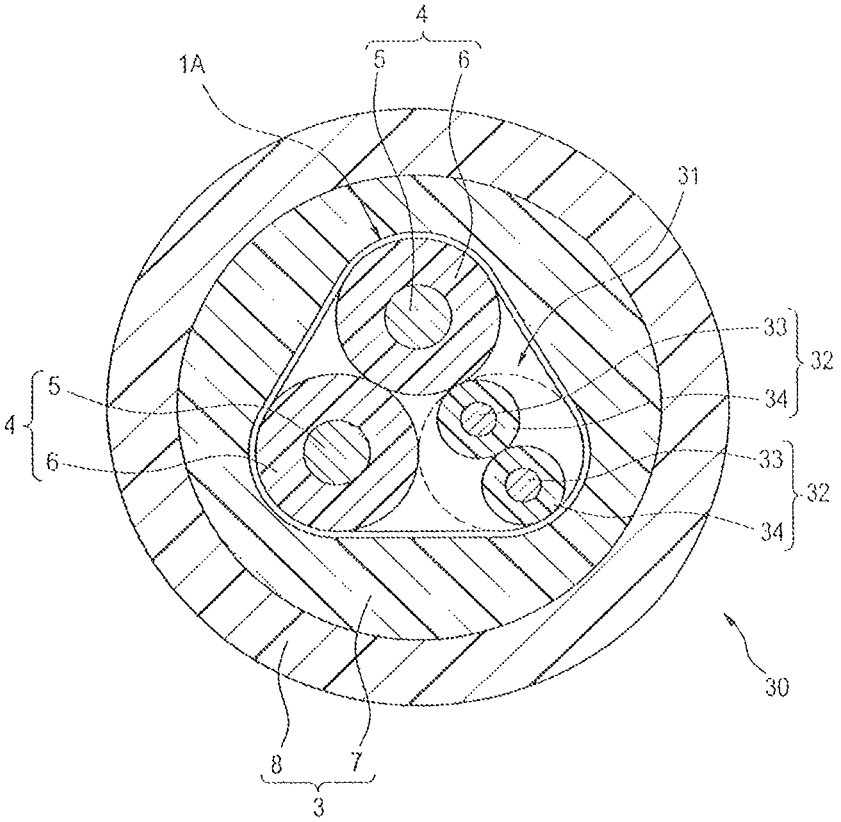
FIG. 3 is a sectional view showing a configuration of an insulated electric cable according to a second embodiment of the invention.

Next, a second embodiment of the invention will be described with reference to FIG. 3. In addition, description is omitted by assigning the same numerals to the same components as those of the first embodiment. FIG. 3 shows a cross section of an insulated electric cable 30 according to the second embodiment. The insulated electric cable 30 of the present example can be used to send an electrical signal for controlling operation of an antilock brake system (ABS) in addition to use for sending an electrical signal of an electro mechanical parking brake.

As shown in FIG. 3, the insulated electric cable 30 of the present example differs from that of the first embodiment in that a core member 1A has a subunit 31 for sending a signal for ABS in addition to two first core wires 4.

The subunit 31 is formed by mutually stranding two second core wires 32 (one example of a core wire) respectively having a diameter smaller than a diameter of the first core wire 4 and the same diameter mutually. Each of the two second core wires 32 is constructed of a conductor 33 and an insulating layer 34 covering an outer periphery of the conductor 33.

The conductor 33 is, for example, a copper alloy wire made of copper alloy, and is a stranded wire formed by stranding a plurality of wires with an outside diameter of 0.08 mm. The number of wires constructing the conductor 33 is about 50 to 70, preferably, about 60. A cross-sectional area of the conductor 33 constructed in this manner is set so as to be in the range of 0.18 to 0.40 mm2, preferably, set at about 0.3 mm2. Also, an outside diameter of the conductor 33 is set so as to be in the range of 0.6 to 1.0 mm, preferably, set at about 0.8 mm. In addition, a material constructing the conductor 33 is not limited to the copper alloy wire, and may be a material such as a tin-plated annealed copper wire or an annealed copper wire with predetermined conductivity and flexibility.

The insulating layer 34 is formed by a flame-retardant polyolefin-based resin, and is formed by, for example, flame-retardant cross-linked polyethylene. A thickness of the insulating layer 34 is set so as to be in the range of 0.2 to 0.4 mm, preferably, set at about 0.3 mm. An outside diameter of the insulating layer 34 is set so as to be in the range of 1.2 to 1.6 mm, preferably, set at about 1.4 mm. In addition, a material constructing the insulating layer 34 is not limited to the flame-retardant cross-linked polyolefin-based resin, and may be formed by other materials such as a cross-linked fluorine resin.

The core member 1A is formed by collectively stranding the subunit 31 and the two first core wires 4 configured as described above. A paper tape 2 is wrapped around an outer periphery of this core member 1A and further, an outer periphery of the paper tape 2 is coated by extrusion to form an inner sheath 7 and an outer sheath 8, and the insulated electric cable 30 is formed.

As described above, the insulated electric cable 30 has the subunit 31 for sending the signal for ABS, and this subunit 31 is formed by stranding the two second core wires 32 in which the cross-sectional area of the conductor 33 is in the range of 0.18 to 0.40 $mm^2$. Then, the core member 1A is formed by stranding this subunit 31 and the two first core wires 4. The insulated electric cable 30 having this core member 1A can send an electrical signal for the antilock brake system as well as an electrical signal for the electro mechanical parking brake mounted in a vehicle. Since the electrical signals for operating two kinds of systems by one cable can be sent thus, convenience of the cable is improved.

In addition, the invention is not limited to the first and second embodiments described above, and can properly make modifications, improvements, etc. Moreover, materials, shapes, dimensions, numerical values, forms, the number of components, arrangement places, etc. of each of the components in the embodiments described above are freely selected and are not limited as long as the invention can be implemented.

For example, as the core wires constructing the core member, the first core wire 4 in which the cross-sectional area of the conductor is in the range of 1.5 to 3.0 $mm^2$ and the second core wire 32 in which the cross-sectional area of the conductor is in the range of 0.18 to 0.40 $mm^2$ are illustrated, but are not limited to this. For example, as long as a cable having at least two core wires in which the cross-sectional area of the conductor is in the range of 0.18 to 3.0 $mm^2$ is configured, the invention can be applied. Also, as long as a cable including at least two first core wires 4 in which the cross-sectional area of the conductor is in the range of 1.5 to 3.0 $mm^2$ is configured, the invention can be applied.

Next, Examples of the invention will be described. Evaluation tests to remove an outer sheath and an inner sheath from insulated electric cables with configurations of the following Examples 1 to 5 were conducted.

Example 1

As an insulated electric cable (for EPB) for test, the cable with each part having the following configuration was manufactured. As a material of a conductor constructing a first core wire, a copper alloy wire (a stranded wire formed by stranding 7 stranded wires formed by stranding 52 wires with an outside diameter of 0.08 mm) was used, and a cross-sectional area (cross-sectional area of the total of wires) of the conductor was set at 1.8 mm2, and an outside diameter of the conductor was set at 2.0 mm. Also, as a material of an insulating layer formed on the periphery of the conductor, flame-retardant cross-linked polyethylene was used, and a thickness of the insulating layer was set at 0.4 mm, and an outside diameter of the insulating layer was set at 2.8 mm. Also, the number of core wires (first core wires) constructing a core member was set at 2, and a strand diameter (outside diameter in a stranded state) was set at 5.6 mm. Also, as a configuration of a tape member, a paper tape with a thickness of 0.03 mm was used, and a paper wrapped diameter was set at 5.7 mm. Also, as a material constructing an inner sheath, cross-linked polyethylene was used, and a thickness of the inner sheath was set at 0.8 mm, and an outside diameter of the inner sheath was set at 7.3 mm. Also, as a material constructing an outer sheath, flame-retardant cross-linked polyurethane was used, and a thickness of the outer sheath was set at 0.5 mm, and an outside diameter of the outer sheath was set at 8.3 mm.

Example 2

As an insulated electric cable (for EPB) for test, the cable with each part having the following configuration was manufactured. As a material of a conductor constructing a first core wire, a copper alloy wire (a stranded wire formed by stranding 7 stranded wires formed by stranding 86 wires with an outside diameter of 0.08 mm) was used, and a cross-sectional area (cross-sectional area of the total of wires) of the conductor was set at 3.0 mm2, and an outside diameter of the conductor was set at 2.6 mm. Also, as a material of an insulating layer formed on the periphery of the conductor, flame-retardant cross-linked polyethylene was used, and a thickness of the insulating layer was set at 0.7 mm, and an outside diameter of the insulating layer was set at 4.0 mm. Also, the number of core wires (first core wires) constructing a core member was set at 2, and a strand diameter (outside diameter in a stranded state) was set at 8.0 mm. Also, as a configuration of a tape member, a paper tape with a thickness of 0.03 mm was used, and a paper wrapped diameter was set at 8.1 mm. Also, as a material constructing an inner sheath, cross-linked polyethylene was used, and a thickness of the inner sheath was set at 0.8 mm, and an outside diameter of the inner sheath was set at 9.7 mm. Also, as a material constructing an outer sheath, flame-retardant cross-linked polyurethane was used, and a thickness of the outer sheath was set at 0.5 mm, and an outside diameter of the outer sheath was set at 10.7 mm.

Example 3

As an insulated electric cable (for EPB) for test, the cable with each part having the following configuration was manufactured. As a material of a conductor constructing a first core wire, a copper alloy wire (a stranded wire formed by stranding 7 stranded wires formed by stranding 42 wires with an outside diameter of 0.08 mm) was used, and a cross-sectional area (cross-sectional area of the total of wires) of the conductor was set at 1.5 mm2, and an outside diameter of the conductor was set at 1.8 mm. Also, as a material of an insulating layer formed on the periphery of the conductor, flame-retardant cross-linked polyethylene was used, and a thickness of the insulating layer was set at 0.4 mm, and an outside diameter of the insulating layer was set at 2.6 mm. Also, the number of core wires (first core wires) constructing a core member was set at 2, and a strand diameter (outside diameter in a stranded state) was set at 5.2 mm. Also, as a configuration of a tape member, a paper tape with a thickness of 0.03 mm was used, and a paper wrapped diameter was set at 5.3 mm. Also, as a material constructing an inner sheath, cross-linked polyethylene was used, and a thickness of the inner sheath was set at 0.8 mm, and an outside diameter of the inner sheath was set at 6.9 mm. Also, as a material constructing an outer sheath, flame-retardant cross-linked polyurethane was used, and a thickness of the outer sheath was set at 0.5 mm, and an outside diameter of the outer sheath was set at 7.9 mm.

Example 4

As an insulated electric cable (for EPB), the cable with each part having the following configuration was manufactured. As a material of a conductor constructing a first core wire, an annealed copper wire (a stranded wire formed by stranding 7 stranded wires formed by stranding 72 wires with an outside diameter of 0.08 mm) was used, and a cross-sectional area of the conductor was set at 2.5 mm2, and an outside diameter of the conductor was set at 2.4 mm. Also, as a material of an insulating layer formed on the periphery of the conductor, flame-retardant cross-linked polyethylene was used, and a thickness of the insulating layer was set at 0.7 mm, and an outside diameter of the insulating layer was set at 3.8 mm. Also, the number of core wires (first core wires) constructing a core member was set at 2, and a strand diameter (outside diameter in a stranded state) was set at 7.6 mm. Also, as a configuration of a tape member, a paper tape with a thickness of 0.03 mm was used, and a paper wrapped diameter was set at 7.7 mm. Also, as a material constructing an inner sheath, cross-linked polyethylene was used, and a thickness of the inner sheath was set at 0.8 mm, and an outside diameter of the inner sheath was set at 9.3 mm. Also, as a material constructing an outer sheath, flame-retardant cross-linked polyurethane was used, and a thickness of the outer sheath was set at 0.5 mm, and an outside diameter of the outer sheath was set at 10.3 mm.

Example 5

As an insulated electric cable (for EPB and ABS), the cable with each part having the following configuration was manufactured. As a material of a conductor constructing a first core wire (for EPB), a tin-plated annealed copper wire (a stranded wire formed by stranding 7 stranded wires formed by stranding 72 wires with an outside diameter of 0.08 mm) was used, and a cross-sectional area ((cross-sectional area of the total of wires)) of the conductor was set at 2.5 mm2, and an outside diameter of the conductor was set at 2.4 mm. Also, as a material of an insulating layer formed on the periphery of the conductor, a cross-linked fluorine-based fluorine resin was used, and a thickness of the insulating layer was set at 0.3 mm, and an outside diameter of the insulating layer was set at 3.0 mm. Also, a material of a conductor constructing a second core wire (for ABS), a copper alloy wire (a stranded wire formed by stranding 60 wires with an outside diameter of 0.08 mm) was used, and a cross-sectional area (cross-sectional area of the total of wires) of the conductor was set at 0.3 mm2, and an outside diameter of the conductor was set at 0.8 mm. Also, as a material of an insulating layer formed on the periphery of the conductor, a cross-linked fluorine resin was used, and a thickness of the insulating layer was set at 0.3 mm, and an outside diameter of the insulating layer was set at 1.4 mm. Also, the number of first core wires constructing a core member was set at 2, and the number of subunits (formed by stranding two second core wires) was set at 1, and a strand diameter (outside diameter in a stranded state) was set at 6.4 mm. Also, as a configuration of a tape member, a polyester-made tape with a thickness of 0.05 mm was used, and the tape wrapped diameter was set at 6.5 mm. Also, as a material constructing an inner sheath, cross-linked polyethylene was used, and a thickness of the inner sheath was set at 0.45 mm, and an outside diameter of the inner sheath was set at 7.4 mm. Also, as a material constructing an outer sheath, flame-retardant cross-linked polyurethane was used, and a thickness of the outer sheath was set at 0.5 mm, and an outside diameter of the outer sheath was set at 8.4 mm.

In each of the insulated electric cables with the configurations of Examples 1 to 5 described above, a test to cut the sheath (the outer sheath and the inner sheath) to a depth corresponding to a thickness of the sheath and form a notch and pull a portion of the distal end side from the notch in a longitudinal direction of the cable and remove the sheath of its portion and expose the core member (each core member) was conducted. As a result of the test, the core member (each core member) could easily be exposed by removing the sheath and exposing the tape member and removing the tape member. Or, the core member could easily be exposed by removing the tape member together with the sheath.

Also, since powder etc., did not attach to the core member, the powder did not fly in the case of removing the sheath. Also, since the tape member was wrapped around the core member, an adhesion between the tape member and the sheath was small and when the sheath was removed, a part of the inner sheath was not stuck on the core member and was not left. Also, a part of the insulating layer of the core member was not removed together with the inner sheath. Also, in the case of pulling and removing the sheath in which the notch was formed, it could be checked that the insulating layer of the core member did not protrude to the distal end side unnecessarily by being pulled integrally to the sheath, that is, it was easy to adjust a length of the exposed portion to a predetermined length. Thus, knowledge that workability of work of removing the sheath from the insulated electric cable was improved by wrapping the tape member on the core member and disposing the tape member between the core member and the inner sheath was obtained.

DESCRIPTION OF REFERENCE NUMERALS AND SIGNS

1, 1A: CORE MEMBER

2: PAPER TAPE (ONE EXAMPLE OF TAPE MEMBER)

3: SHEATH

4: FIRST CORE WIRE

5, 33: CONDUCTOR

6, 34: INSULATING LAYER

7: INNER SHEATH (ONE EXAMPLE OF FIRST COATING LAYER)

8: OUTER SHEATH (ONE EXAMPLE OF SECOND COATING LAYER)

10, 30: INSULATED ELECTRIC CABLE

11: MANUFACTURING APPARATUS

12: CORE WIRE SUPPLY REEL

13: STRANDING PART

14: PAPER TAPE SUPPLY REEL

15: PAPER TAPE WRAPPING PART

16: INNER SHEATH COATING PART

17: OUTER SHEATH COATING PART

18: COOLER

19: CABLE WINDING REEL

32: SECOND CORE WIRE

The invention claimed is:

1. An insulated electric cable comprising:

a core member formed by stranding a plurality of core wires, each of the core wires including a conductor and an insulating layer covering the conductor;

a first coating layer which is formed of extruded resin covering the core member;

a second coating layer covering the first coating layer; and a tape member disposed between the core member and the first coating layer in a state that it is wrapped around only the core member, wherein the insulating layer does not include magnetic powder, wherein the first coating layer covers only the core member and the tape member, wherein the second coating layer is formed by a flame-retardant polyurethane-based resin, wherein the core member has two first core wires respectively being discrete from each other and having a same diameter as each other and two second core wires respectively having a second diameter different from that of the two first core wires, the two second core wires are mutually stranded to form a subunit, and the subunit and the two first core wires are stranded to form the core member, and wherein a cross-sectional area of a conductor of the first core wires is greater than that of the second core wires.

* * * * *